United States Patent [19]

Deutsch

[11] Patent Number: 4,638,707

[45] Date of Patent: Jan. 27, 1987

[54] DATA MASK TONE VARIATION IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 657,648

[22] Filed: Oct. 4, 1984

[51] Int. Cl.[4] ..... G10H 1/06

[52] U.S. Cl. ..... 84/1.19; 84/1.22

[58] Field of Search ..... 84/1.23, 1.19, 1.01, 84/1.22

[56] References Cited

U.S. PATENT DOCUMENTS 4,244,257 1/1981 Niimi et al. ..... 84/1.01

4,300,434 11/1981 Deutsch ..... 84/1.01

*Primary Examiner*—Arthur T. Grimley

*Assistant Examiner*—David Wallen

*Attorney, Agent, or Firm*—Ralph Deutsch

[57] ABSTRACT

A keyboard operated electronic musical instrument is disclosed which has a number of tone generators that are assigned to actuated keyswitches. The generated musical tones are selectively varied in tone color by multiplying tone data values by a masking function. A library of masking functions are stored and are selected by a control signal. Musical tones with time variant harmonics can be generated.

18 Claims, 6 Drawing Figures

DATA MASK TONE VARIATION IN AN ELECTRONIC MUSICAL INSTRUMENT

BACKGROUND OF THE INVENTION

1. Field of the Invention

This invention relates to electronic musical tone synthesis and in particular is concerned with varying the musical waveshapes by deleting selected portions of a waveshape by means of a data mask.

2. Description of the Prior Art

Electronic musical tone generating systems embody a variety of techniques for creating a number of differentiable tones which can be selected by the musician to provide a tonal color setting appropriate to a musical performance. To this end, tone generators are provided which can provide a plurality of different tones that can be selected either singly or in combination in response to the actuation of a number of tone switches. Tone switches are often called stops as a remembrance of the controls used to control ranks of wind-blown organ pipes.

Tone synthesizers provide an important additional dimension to musical tone generation by creating tones in which the harmonic content is varied as a function of time. A simple tone having a waveshape that is repeated cyclically and endlessly quite rapidly fatigues a listener. This fatigue phenomena is a negative attribute of most simple tone generating schemes. Even a wind-blown organ pipe has a tone variant spectra produced by air turbulence and a constant and random acoustic phase interference in the auditorium containing the organ pipes.

Both in the interest of circuit implementation economy as well as a means to obtain special tonal effects, musical tone generators have been employed which use various forms of waveshape distortion to obtain several types of tone colors for each individual tone controlled by an associated tone switch. An example of such a waveshape distortion system is disclosed in U.S. Pat. No. 4,300,432 entitled "Polyphonic Tone Synthesizer With Loudness Spectral Variation." A combination of waveshape distortion and a sliding formant filter is disclosed in U.S. Pat. No. 4,300,434 entitled "Apparatus For Tone Generation With Combined Loudness And Formant Spectral Variation."

A system for distorting a basic musical waveshape stored in a digital data memory is described in U.S. Pat. No. 4,183,275 entitled "Electronic Musical Instrument." The distortion is obtained by changing the memory advance read out rate at preselected memory address points. The result is equivalent to a frequency modulation.

A common technique for distorting a musical waveshape is to use some form of signal modulation. Several musical instruments have been designed which employ frequency modulation subsystems to produce time variant distortions of a simple sinusoid signal at the musical tones fundamental frequency. Phase modulation subsystems produce exactly equivalent distortions as those achieved with frequency modulation.

Amplitude signal modulation has also been utilized in musical tone generators to modify the spectra of an input signal. Ring modulators, or balanced modulators, are almost a standard feature for tone generators of the synthesizer genre.

Most of the commonly implemented waveshape distortion techniques require the use of a data multiplier.

This is a relatively expensive item for a digital tone generation system. Even with the current trend toward the use of low cost microelectronic structures, a binary data multiplier is still a comparatively expensive and low speed device.

SUMMARY OF THE INVENTION

In a polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is created. The master data set comprises a set of data points which define a period of a musical waveshape.

The master data is computed using a set of stored harmonic coefficients. After the master data set is computed, a transfer cycle is initiated during which the master data set is transferred to a note register. There is a note register associated with each tone generator. The transferred data is modified by a gating operation in response to a masking function stored in a mask memory. The result is a musical tone whose spectra can be varied by appropriate selection of the masking function.

BRIEF DESCRIPTION OF THE DRAWINGS

The detailed description of the invention is made with reference to the accompanying drawings wherein like numerals designate like components in the figures.

FIG. 3 is a schematic diagram of a second embodiment of the invention.

DETAILED DESCRIPTION OF THE INVENTION

The present invention is directed toward a polyphonic tone system wherein waveshapes are modified in tone color by selectively masking portions of an input waveshape. The tone modification system is incorporated into a musical instrument of the type which synthesizes musical waveshapes by implementing a discrete Fourier transform algorithm. A tone generation system of this category is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent.

Figure 1:
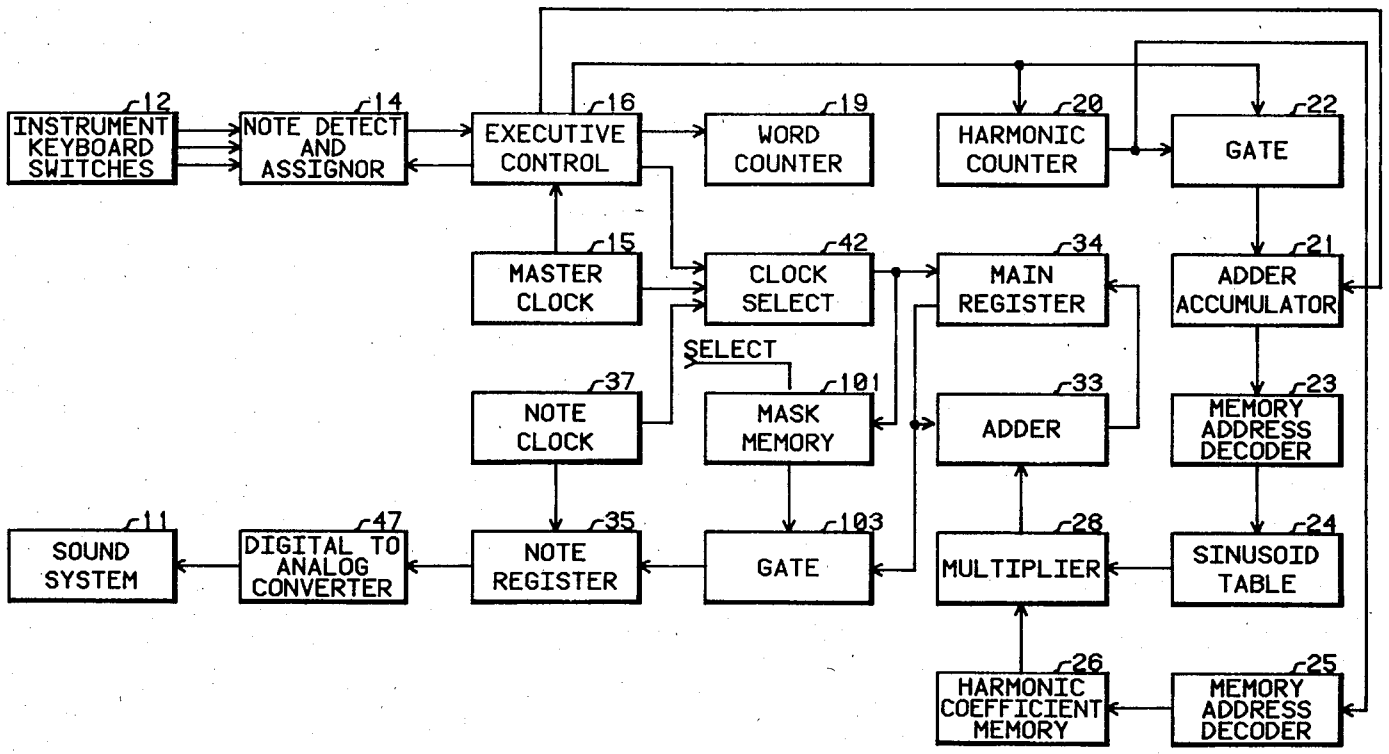
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. A tone generator is assigned to each actuated keyswitch using information generated by the note detect and assignor 14. One tone generator is shown explicitly in FIG. 1. It comprises the note register 35 and note clock 37. All the tone generators share data stored in the main register 34 which is computed during a computation cycle.

A suitable note detect and assignor subsystem is described in U.S. Pat. No. 4,022,098 which is hereby incorporated by reference.

When one or more keyswitches have been actuated, the executive control 16 initiates a repetitive sequence of computation cycles. During each computation cycle, a master data set is computed. The 64 data words in a master data set correspond to the amplitudes of 64 equally spaced points of one cycle of the audio waveform for the musical tone produced by the tone generators. The general rule is that the maximum number of harmonics in the audio tone spectra is no more than one-half of the number of data points in one complete waveshape period. Therefore, a master data set comprising 64 data words corresponds to a musical waveshape having a maximum of 32 harmonics.

As described in the referenced U.S. Pat. No. 4,085,644 it is desirable to be able to continuously recompute and store the master data set during a repetitive sequence of computation cycles and to load this data into the note registers which are associated with each one of the tone generators while the actuated keyswitches remain actuated, or depressed, on the keyboards.

In the manner described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its initial, or minimal, count state because of its modulo counting implementation, a signal is generated by the executive control 16 which increments the count state of the harmonic counter 20. The word counter 19 is implemented to count modulo 64 which is the number of data words comprising the master data set. The harmonic counter 20 is implemented to count modulo 32. This number corresponds to the maximum number of harmonics consistent with a master data set comprising 64 data words.

At the start of each computation cycle, the accumulator in the adder-accumulator 21 is initialized to a zero value by the executive control 16. Each time that the word counter is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function $\sin(2\pi\phi/64)$ for $0 \leqq \phi \leqq 64$ at intervals of D. D is a table resolution constant.

The memory address decoder 25 reads out harmonic coefficients stored in the harmonic coefficient memory 26 in response to the count state of the harmonic counter 20. The multiplier 28 generates the product value of the trigonometric value read out from the sinusoid table 24 and the value of the harmonic coefficient read out from the harmonic coefficient memory 26. The generated product value formed by the multiplier 28 is furnished as one input to the adder 33.

The contents of the main register 34 are initialized to a zero value at the start of each computation cycle. Each time that the word counter 19 is incremented, the content of the main register 34, at an address corresponding to the count state of the word counter 19, is read out and furnished as an input to the adder 33. The sum of the inputs to the adder 33 are stored in the main register 34 at a memory location equal, or corresponding, to the count state of the word counter 19. After the word counter 19 has been cycled for 32 complete cycles of 64 counts, the main register 34 will contain the master data set which comprises a complete period of a musical waveshape having a spectral function determined by the set of harmonic coefficients provided to the multiplier 28.

Following each computation cycle in the repetitive sequence of computation cycles, a transfer cycle is initiated and executed. During a transfer cycle data is simultaneously read out of the main register 34 and the mask memory 101. The data read out of the mask memory is a binary digital word comprising a sequence of "0" and "1" binary state levels. The gate 103 permits a data point value read out of the main register 34 to be transferred unaltered to be stored in the note register 35 if the current data value output from the mask memory 101 is a binary logic state "1". If the binary logic state from the mask memory 101 is a "0", then the gate 103 inhibits the data read out of the main register 34 and a zero data value is stored in the note register 35.

The data set stored in the note register 35 is sequentially and repetitively read out in response to timing signals provided by the note clock 37. The read out data is converted into an analog signal by means of the digital-to-analog converter 47. The resultant analog signal is transformed into an audible musical sound by means of the sound system 11. The sound system 11 contains a conventional amplifier and speaker combination for producing audible tones.

The mask memory 101 is configured to store a number of masks each of which comprises a 64 bit binary digital data word. The word length of 64 bits corresponds to the number of data points in the master data set that is stored in the main register 34. The SELECT signal input to the mask memory 101 is used to select one of the plurality of stored masks to be read out in a bit sequence in response to the timing signals provided by the clock select 42.

The number of possible mask words is very large and is equal to $2^{64}-1$ which is approximately $1.8\times10^{19}$. It is obviously an almost impossible task to examine the effect of this large number of possible masks for even a limited number of waveshapes computed and stored in the main register 34. A limited number of masks and their effect upon waveshapes was studied using a computer system simulation technique. The selection of masks was based upon a somewhat arbitrary selection criterion biased by some symmetry aspects of the 64 bit word patterns. The following set of 20 masks were found to produce some interesting and useful musical tone effects. To simplify the listing of the mask bit sequences, the 64 bit binary number is written as four hexadecimal numbers. For example, the 16 bit binary number 1000 1101 0001 1100 can be represented as the single hexadecimal number 8DIC.

| Mask Word Number | Hexadecimal Mask |
|---|---|
| 1. | FFFF,FFFF,FFFF,FFFF |
| 2. | CCCC,CCCC,CCCC,CCCC |
| 3. | FOFO,FOFO,FOFO,FOFO |
| 4. | FCFC,FCFC,FCFC,FCFC |
| 5. | FFOO,FFOO,FFOO,FFOO |
| 6. | A8A8,A8A8,A8A8,A8A8 |
| 7. | FFCO,FFCO,FFCO,FFCO |
| 8. | AABC,AABC,AABC,AABC |
| 9. | FFFF,DB6C,FFFF,DB6C |
| 10. | FFFF,3330,FFFF,3330 |
| 11. | F3CF,3CF3,CF3C,F3CF |
| 12. | FFCO,FFCO,FFCC,FFCO |
| 13. | FFEO,FFEO,FFEO,FFEO |
| 14. | FFFO,FFFO,FFFO,FFFO |
| 15. | FFF8,FFF8,FFF8,FFF8 |
| 16. | FFFC,FFFC,FFFC,FFFC |
| 17. | F3CF,F3CF,F3CF,F3CF |
| 18. | A28A,A28A,A28A,A28A |
| 19. | AA88,AA88,AA88,AA88 |
| 20. | FFCC,FFCC,FFCC,FFCC |

The first mask consists of a sequence of 64 bits each having the binary value "1". This mask, when selected, does nothing but cause the master data set to be transferred in an unaltered form to the note register 35.

Figure 2:
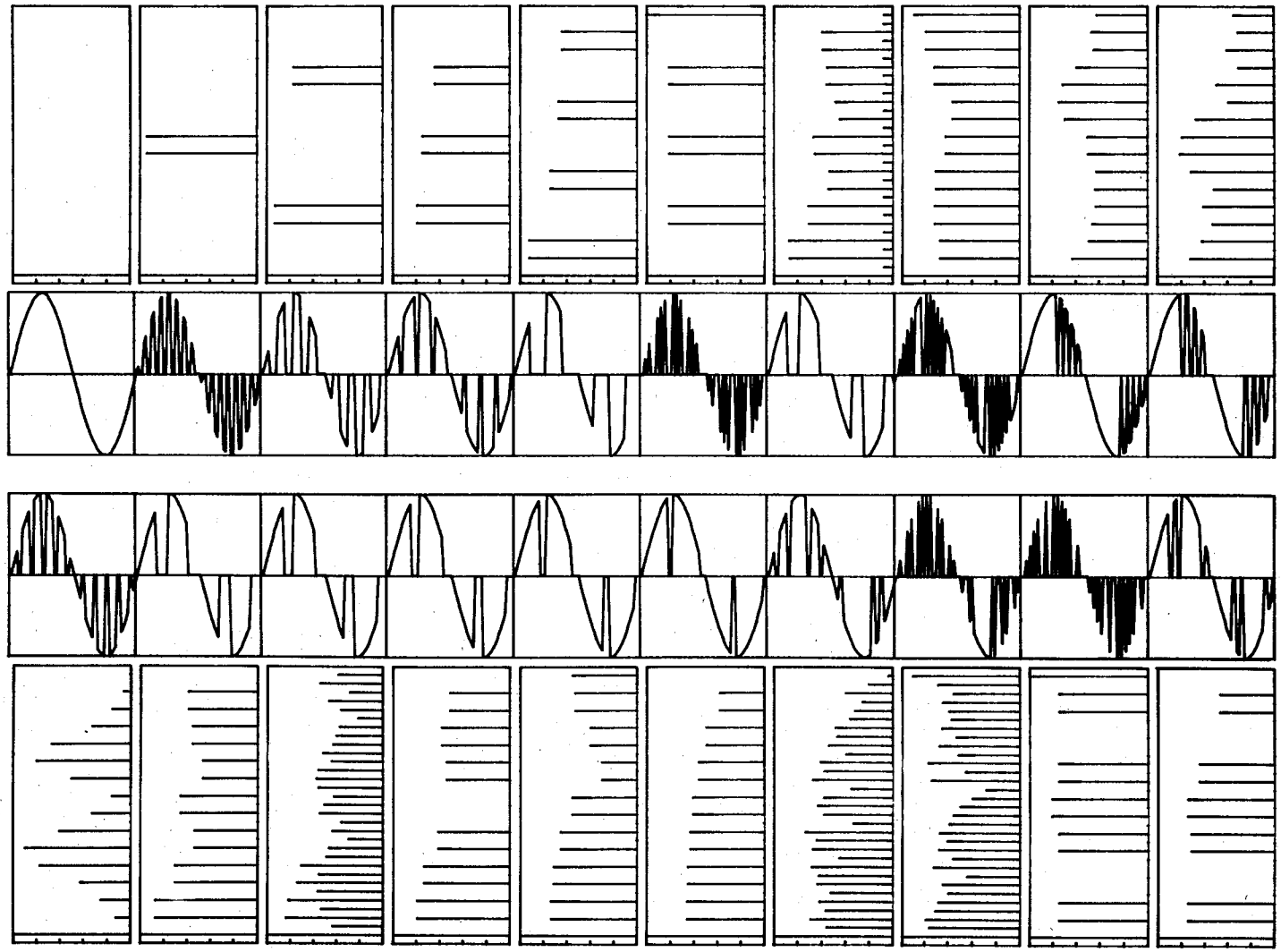
FIG. 2 is a spectrum and waveshape plot of a system simulation.

FIG. 2 illustrates the result of a computer simulation of the mask effects on a master data set. The selected master data set consists of 64 equally spaced points for a simple sinusoid signal. Each spectrum in the top row of spectra in FIG. 2 corresponds to the waveshape drawn immediately below it. Each spectrum in the bottom row of spectra corresponds to the waveshape drawn immediately above it. Each of the waveshapes in the second row of curves corresponds to the result of applying masks 1–10 to the sinusoid data stored in the main register 34. Each of the waveshapes in the third row of curves corresponds to the result of applying masks 11–20 to the sinusoid table stored in the main register 34. The tic marks for the spectra corresponds to the interval of −10 db measured from a maximum of 0 db.

FIG. 2 graphically illustrates the wide variety of tones that can be obtained by using the inventive data masking technique even for the simplest case in which the master data set corresponds to a sinusoid waveform. Time variant tones can be created by using a time variant signal for the SELECT signal which chooses a mask function stored in the mask memory 101. An ADSR (attack/decay/sustain/release) envelope signal can be used for the SELECT signal.

The data mask operation can be inserted in several alternate data flow paths in the basic Polyphonic Tone Synthesizer. FIG. 3 illustrates a second alternate embodiment of the invention. In this arrangement the gate 103 is inserted in the signal data path between the output of the adder 33 and the main register 34. This arrangement results in a master data set residing in the main register 34 which is already modified by the masking function accessed from the mask memory 101.

Figure 4:
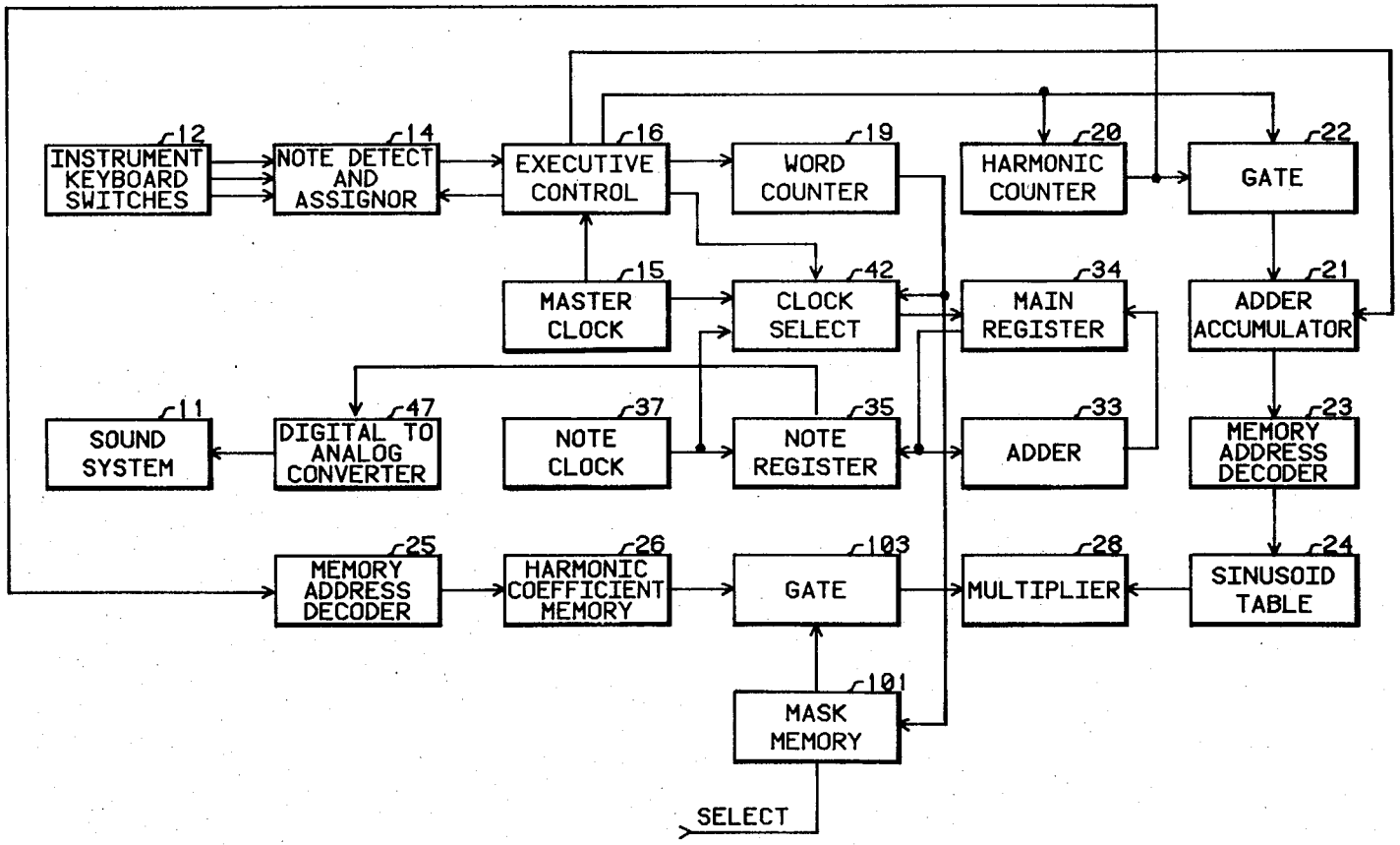
FIG. 4 is a schematic diagram of a third embodiment of the invention.
Figure 5:
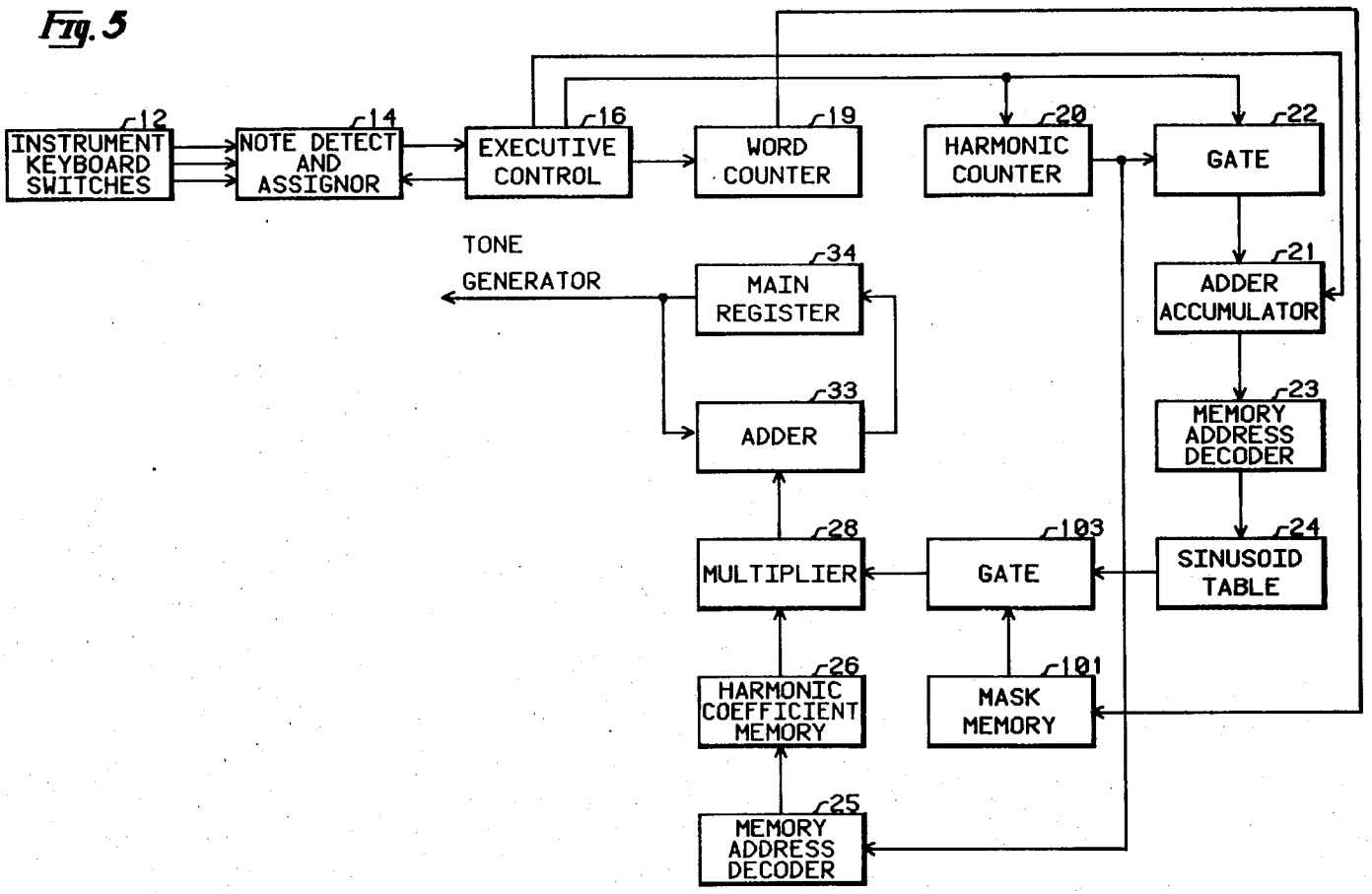

FIG. 4 illustrates a third embodiment of the invention. In this arrangement the gate 103 is inserted between the output of the harmonic coefficient memory 26 and the multiplier 28. The mask function is read out of the mask memory 101 in response to the count state of the word counter 19. The net result is that at the end of a computation cycle, the master data set residing in the main register 34 has already been modified by the masking function accessed out from the mask memory 101.

Figure 5:
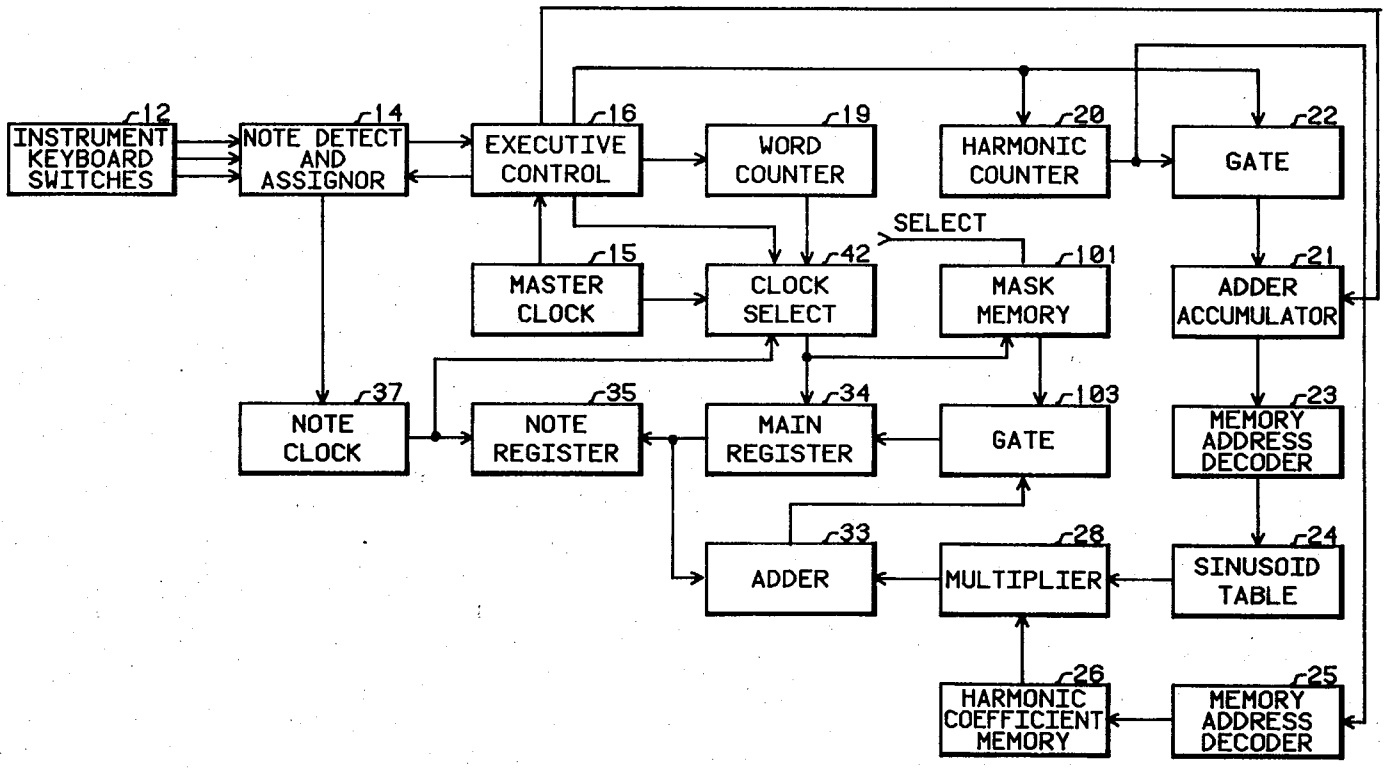
FIG. 5 is a schematic diagram of a fourth embodiment of the invention.

FIG. 5 illustrates a fourth embodiment of the invention. In this arrangement the gate 103 is inserted between the output of the sinusoid table and the multiplier 28. The mask function is read out of the mask memory 101 in response to the count state of the word counter 19. The net result is that, at the end of computation cycle, the master data set residing in the main register 34 has already been modified by the masking function accessed out from the mask memory 101.

An advantage to the system arrangement shown in FIG. 1 is that two different tones can be simultaneously obtained from the single master data set computed and stored in the main register 34. The first tone can be obtained from the unmodified master data set and the second is that obtained by gating the master data set using a masking function. These can be summed to obtain a combination tone in which either, or both, can be selected by using two tone switches on the input signal lines to the data summation means.

Figure 6:
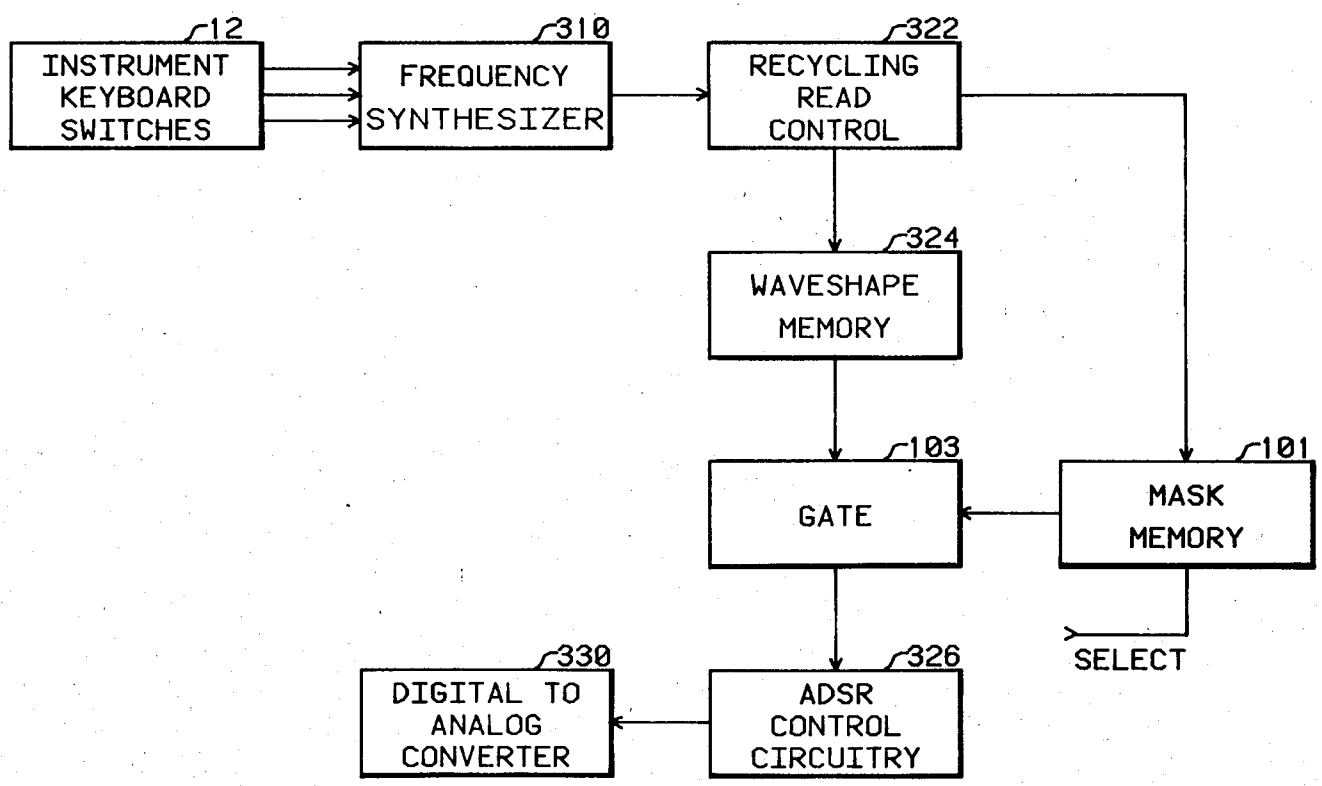
FIG. 6 is a schematic diagram of the invention used as a subsystem of a Digital Organ.

The present invention can also be incorporated into other musical tone generation systems. FIG. 6 illustrates an arrangement in which the masking function is incorporated into a tone generation system of the type described in U.S. Pat. No. 3,515,792 entitled "Digital Organ." This patent is hereby incorporated by reference.

The system logic blocks in FIG. 6 with "300" series numbers correspond to blocks shown in FIG. 1 of the referenced U.S. Pat. No. 3,515,792 which are numbered with the last two digits of the corresponding "300" series number. The gate 103 is inserted between the data read out sequentially and repetitively from the waveshape memory 342 and the input to the ADSR control circuitry 326. The stored mask function is read out of the mask memory 101 in response to the output address signal generated by the recycling read control 322.

Instead of using stored mask functions residing in a mask memory, various arrangements can be used to generate a mask function in response to the signals that would otherwise be used to address the mask memory 101. Such arrangements include counters with feedback paths which inhibit various preselected count states. Any arrangement for constructing selected binary data words of a fixed word length can readily be used as a substitute for the mask memory 101.

I claim:

1. In combination with a musical instrument in which a plurality of data words corresponding to the amplitudes of points defining the waveform of a musical tone are computed from a preselected set of harmonic coefficients and are transferred sequentially to a means for conversion into musical waveshapes, apparatus for selectively modifying said waveform of a musical tone in response to a control signal comprising;

a first waveshape memory means, a means for computing responsive to said preselected set of harmonic coefficients whereby said plurality of data words corresponding to the amplitudes of points defining the waveform of a musical tone are computed and stored in said first waveshape memory means, a mask data generator means for creating a mask data word in response to said control signal wherein said mask data word is in a binary digital format having a number of bits equal in number to said plurality of data words corresponding to the amplitudes of points defining the waveform of a musical tone, a memory addressing means for simultaneously reading out a data word stored in said first waveshape memory means and for selecting a corresponding bit of said mask data word created by said mask data generator means, a second waveshape memory means, a mask gate responsive to said selected bit provided by said memory addressing means whereby said data word read out from said first memory means is transferred unaltered if the corresponding bit of said mask data word has a logic value of "1" and whereby a zero value data word is transferred if said corresponding bit of said mask data word has a logic value of "0" and whereby the transferred data words are stored in said second waveshape memory means, a waveshape reading means whereby data words are sequentially and repetitively read out from said second waveshape memory means, and a means for producing musical tones responsive to product data words read out of said second waveshape memory means.

2. In a musical instrument according to claim 1 wherein said mask data generator means comprises;

a mask memory means for storing a number of mask data words at selectable memory addresses.

3. In a musical instrument according to claim 2 wherein said memory addressing means comprises;

a select means responsive to a control signal whereby a corresponding one of said plurality of memory locations is selected, and a sequencer means whereby the binary digital word stored in said selected memory location is read out in a serial sequence of binary bits.

4. In combination with a musical instrument in which a plurality of data words corresponding to the amplitudes of points defining the waveform of a musical tone are computed from a preselected set of harmonic coefficients and are transferred sequentially to a means for conversion into musical waveshapes, apparatus for selectively modifying said waveform of a musical tone comprising;

a first waveshape memory means, a means for computing responsive to said preselected set of harmonic coefficients whereby said plurality of data words corresponding to the amplitudes of points defining the waveform of a musical tone are computed and stored in said first waveshape memory means, a mask memory comprising a plurality of memory locations each of which contains a preselected mask function comprising a binary digital word having a number of bits equal in number to the number of memory addresses in said first waveshape memory means, a select means responsive to a control signal whereby a corresponding one of said plurality of memory locations is selected, an addressing means for reading out data words stored in said first waveshape memory means and for reading out in a serial sequence of binary bits the digital word stored in said selected memory location, a second waveshape memory means, a mask gate responsive to said serial sequence of binary bits whereby a data word read out from said first memory means is stored unaltered in said second memory means if the binary bit in said sequence of binary bits has a logic value of "1" and whereby a zero product data word is stored in said second memory means if the binary bit in said sequence of binary bits has a logic value of "0"

a waveshape reading means whereby said product data words are sequentially and repetitively read out of said second waveshape memory means, and a means for producing musical tones responsive to product data words read out of said second waveshape memory means.

5. In combination with a musical instrument in which a plurality of data words corresponding to the amplitudes of points defining the waveform of a musical tone are computed from a preselected set of harmonic coefficients during each one of a sequence of computation cycles and are transferred sequentially to a means for conversion into musical waveshapes, apparatus for selectively modifying said waveform of a musical tone in response to a control signal comprising;

a first waveshape memory means, a mask data generating means for creating a mask data word in response to said control signal wherein said mask data word is in a binary digital format having a number of bits equal in number to said plurality of data words defining said waveform of a musical tone, a harmonic memory means for storing said preselected harmonic coefficients, a memory addressing means for simultaneously reading out a harmonic coefficient from said harmonic memory means and for selecting a corresponding bit of said mask data word created by said mask generating means, a mask-gate responsive to said selected bit provided by said memory addressing means whereby said harmonic coefficient read out from said harmonic memory means is transferred unaltered if the corresponding bit of said mask data word selected by said memory addressing means has a logic value of "1" and whereby a zero value harmonic coefficient is transferred if said corresponding bit of said mask data word selected by said memory addressing means has a logic value of "0", a means for computing responsive to harmonic coefficients transferred by said mask gate and whereby a plurality of data words corresponding to said modified musical tone are computed and stored in said first waveshape memory means, a second waveshape memory means, a waveshape transfer means whereby said plurality of data words stored in said first waveshape memory means are transferred and stored in said second waveshape memory means, a waveshape reading means whereby said plurality of data words are sequentially and repetitively read out of said second waveshape memory means, and a means for producing musical tones responsive to data words read out of said second waveshape memory means.

6. In a musical instrument according to claim 5 wherein said mask data generator means comprises;

a mask memory means for storing a number of mask data words at selectable memory addresses.

7. In a musical instrument according to claim 6 wherein said memory addressing means comprises;

a select means responsive to a control signal whereby a corresponding one of said plurality of memory locations is selected, and a sequencer means whereby the binary digital word stored in said selected memory location is read out in a serial sequence of binary bits.

8. In combination with a musical instrument in which a plurality of data words corresponding to the amplitudes of points defining the waveform of a musical tone are computed from a preselected set of harmonic coefficients during each one of a sequence of computation cycles and are transferred sequentially to a means for conversion into musical waveshapes, apparatus for selectively modifying said waveform of a musical tone comprising:

a first waveshape memory means, a mask memory comprising a plurality of memory locations each of which contains a preselected mask function comprising a binary digital word having a number of bits equal in number to the number of memory addresses in said first waveshape memory means, a select means responsive to a control signal whereby a corresponding one of said plurality of memory locations is selected, a sequencer means whereby the binary digital word stored in said selected memory location is read out in a serial sequence of binary bits, a harmonic coefficient memory for storing said preselected set of harmonic coefficients, a logic clock means for providing logic timing signals, a word counter for counting said logic timing signals modulo the number of addresses in said first waveshape memory means, a harmonic counter incremented each time said word counter returns to its minimal count state and wherein said harmonic counter counts modulo the number of harmonic coefficients in the preselected set of harmonic coefficients stored in said harmonic coefficient memory, an adder-accumulator means wherein the count state of said harmonic counter is successively added to the content of an accumulator in response to said logic timing signals and wherein the content of said accumulator is initialized to a zero value at the start of each one of said sequence of computation cycles, a sinusoid table storing a set of trigonometric function values, a sinusoid table addressing means responsive to the content of said adder-accumulator means for reading out a trigonometric function value from said sinusoid table, a harmonic addressing means responsive to the count state of said harmonic counter whereby a harmonic coefficient is read out of said harmonic coefficient memory, a calculation means responsive to said trigonometric functions read out from said sinusoid table, responsive to the harmonic coefficients read out of said harmonic coefficient memory, and said serial sequence of binary bits read out from said mask memory, whereby said plurality of data words corresponding to the amplitudes of points defining the waveform of a musical tone are computed and stored in said first waveshape memory means a second waveshape memory means, a waveshape transfer means whereby said plurality of data words stored in said first waveshape memory means are transferred and stored in said second waveshape memory means, a waveshape reading means whereby said plurality of data words are sequentially and repetitively read out of said second waveshape memory means, and a means for producing musical tones responsive to data words read out of said second waveshape memory means.

9. In a musical instrument according to claim 8 wherein said calculation means comprises;

a first multiplying means whereby said trigonometric function value read out from said sinusoid table is multiplied by a harmonic coefficient read out of said harmonic coefficient memory to form an output product value, a summing means wherein said output product value is added to a data word read out of said first waveshape memory means in response to the count state of said word counter to form a summed value, a second multiplying means whereby said summed value is multiplied by the mask function read out from said mask memory to form a masked data word, and a waveshape writing means, responsive to the count state of said word counter, whereby said masked data word is stored in said first waveshape memory means.

10. In a musical instrument according to claim 9 wherein said sequencer means comprises;

a sequencer addressing means responsive to the count state of said word counter whereby a binary bit is read out from said selected memory location.

11. In a musical instrument according to claim 10 wherein said second multiplying means comprises;

a mask gate responsive to said serial sequence of binary bits created by said sequencer means whereby said summed value is transferred unaltered to said waveshape writing means if the binary bit in said sequence of binary bits has a logic value of "1" and whereby a zero value masked data word is transferred to said waveshape writing means if the binary bit in said sequence of binary bits has a logic value of "0".

12. In a musical instrument according to claim 8 wherein said calculation means comprises;

a first multiplying means whereby a harmonic coefficient read out of said harmonic coefficient memory is multiplied by the mask function read out of said mask memory to form a masked harmonic coefficient value, a second multiplying means whereby said trigonometric function value read out from said sinusoid table is multiplied by said masked harmonic coefficient value to form an output product value, a summing means wherein said output product value is added to a data word read out from said first waveshape memory means in response to the count state of said word counter to form a summed value, and a waveshape writing means, responsive to the count state of said word counter, whereby said summed value is stored in said first waveshape memory means.

13. In a musical instrument according to claim 12 wherein said sequencer means comprises;

a sequencer addressing means responsive to the count state of said word counter whereby a binary bit is read out from said selected memory location.

14. In a musical instrument according to claim 13 wherein said first multiplying means comprises;

a mask gate responsive to said serial sequence of binary bits created by said sequencer means whereby said harmonic coefficient read out of said harmonic coefficient memory is transferred unaltered to said second multiplying means if the binary bit in said sequence of binary bits has a logic value of "1" and whereby a zero value masked coefficient value is transferred to said second multiplying means if the binary bit in said sequence of binary bits has a logic value of "0".

15. In a musical instrument according to claim 8 wherein said calculation means comprises;

a first multiplying means whereby a trigonometric value read out of said sinusoid table is multiplied by the mask function read out of said mask memory to form a masked trigonometric function value, a second multiplying means whereby said masked trigonometric function is multiplied by a harmonic coefficient value read out of said harmonic coefficient memory to form an output product value, a summing means wherein said output product value is added to a data word read out from said first waveshape memory means in response to the count state of said word counter to form a summed value, and a waveshape writing means, responsive to the count state of said word counter, whereby said summed value is stored in said first waveshape memory means.

16. In a musical instrument according to claim 15 wherein said sequencer means comprises;

a sequencer addressing means responsive to the count state of said word counter whereby a binary bit is read out from said selected memory location.

17. In a musical instrument according to claim 16 wherein said first multiplying means comprises;

a mask gate responsive to said serial sequence of binary bits created by said sequencer means whereby said trigonometric function value read out of said sinusoid table is transferred unaltered to said second multiplying means if the binary bit in said sequence of binary bits has a logic value of "1" and whereby a zero value masked trigonometric function value is transferred to said second multiplying means if the binary bit in said sequence of binary bits has a logic value of "0".

18. In combination with a musical instrument in which a plurality of data words corresponding to the amplitudes of points defining the waveform of a musical tone are stored in a waveshape memory and are sequentially and repetitively read out and transferred to a means for conversion into musical waveshapes, apparatus for selectively modifying said waveform of a musical tone in response to a control signal comprising;

a waveshape memory means storing said plurality of data words, a mask data generator means for creating a mask data word in response to said control signal wherein said mask data word is in a binary digital format having a number of bits equal in number to said plurality of data words, a memory addressing means for simultaneously reading out a data word stored in said waveshape memory means and selecting a corresponding bit of said mask data word created by said mask data generator means, a mask gate responsive to said selected bit provided by said memory addressing means whereby said data word read out from said waveshape memory means is transferred unaltered if the corresponding bit of said mask data word has a logic value of "1" and whereby a zero value data word is transferred if said corresponding bit of said mask data word has a logic value of "0", and a means for producing musical tones responsive to said masked data words.

* * * * *